US012117204B2

(12) United States Patent
Lurati et al.

(10) Patent No.: US 12,117,204 B2
(45) Date of Patent: Oct. 15, 2024

(54) HOT AIR HANDHELD DEVICE

(71) Applicant: Leister Technologies AG, Kägiswil (CH)

(72) Inventors: Stefan Lurati, Sarnen (CH); Ivo Ulrich, Eschenbach (CH)

(73) Assignee: Leister Technologies AG, Kägiswil (CH)

( * ) Notice: Subject to any disclaimer, the term of this patent is extended or adjusted under 35 U.S.C. 154(b) by 0 days.

(21) Appl. No.: 18/689,340

(22) PCT Filed: Sep. 6, 2022

(86) PCT No.: PCT/EP2022/074729
§ 371 (c)(1),
(2) Date: Mar. 5, 2024

(87) PCT Pub. No.: WO2023/031480
PCT Pub. Date: Mar. 9, 2023

(65) Prior Publication Data

US 2024/0263840 A1 Aug. 8, 2024

(30) Foreign Application Priority Data

Sep. 6, 2021 (DE) ..... 20 2021 104 784.4

(51) Int. Cl.
*F24H 15/37* (2022.01)
*F24H 3/04* (2022.01)
(Continued)

(52) U.S. Cl.
CPC ..... *F24H 15/37* (2022.01); *F24H 3/0423* (2013.01); *F24H 9/0063* (2013.01); *F24H 15/208* (2022.01)

(58) Field of Classification Search
None
See application file for complete search history.

(56) References Cited

U.S. PATENT DOCUMENTS 3,610,881 A * 10/1971 Stewart ..... H05B 3/0019 219/400
3,689,737 A * 9/1972 Eckles ..... H05B 3/0061 219/535

(Continued)

FOREIGN PATENT DOCUMENTS

CN 111971514 A 11/2020
DE 202017103466 U1 7/2017

(Continued)

OTHER PUBLICATIONS

English translation of International Search Report corresponding to application PCT/EP2022/074729, dated Dec. 6, 2022, 2 pages.

(Continued)

*Primary Examiner* — Thor S Campbell
(74) *Attorney, Agent, or Firm* — Reising Ethington P.C.

(57) ABSTRACT

A hand-held hot air device is provided with a housing for at least a fan, a control device, actuating elements and a display and operating device as well as a heating tube arranged at the housing with an integrated heating element and temperature sensor, characterized in that in the control device as a function of a plurality of different air guide options for the hot air emerging from the heating tube after the heating tube there are provided calibration curves, wherein the hand-held hot air device with the control device is configured to, after setting the respective air guide at the outlet from the heating tube, output the air temperature at the location corresponding with the air guide on the display in accordance with the calibration curve of the air guide. Further, a corresponding method for operating a hand-held hot air device is provided.

13 Claims, 2 Drawing Sheets

(51) Int. Cl.
*F24H 9/00* (2022.01)
*F24H 15/208* (2022.01)

(56) References Cited

U.S. PATENT DOCUMENTS 4,094,076 A * 6/1978 Baslow ..... A45D 20/12 392/382
4,635,382 A * 1/1987 Bourdeau ..... A45D 20/06 34/493
4,967,060 A * 10/1990 Lomeli ..... A47L 23/205 239/DIG. 21
5,671,321 A * 9/1997 Bagnuolo ..... A45D 20/122 392/383
6,304,720 B1 10/2001 Richard
6,449,870 B1 * 9/2002 Perez ..... A45D 20/30 392/374
7,356,942 B2 * 4/2008 Lin ..... F23D 14/38 431/344
8,948,577 B2 * 2/2015 Eberli ..... F24H 15/37 392/383
9,635,713 B2 * 4/2017 Groves ..... F26B 13/001
10,094,590 B2 * 10/2018 Chen ..... F24H 3/12
10,876,763 B2 * 12/2020 Han ..... F24H 3/0423
11,033,088 B2 * 6/2021 Atkinson ..... A45D 20/12
11,771,196 B2 * 10/2023 Lei ..... A45D 20/12 34/97
11,965,676 B2 * 4/2024 Albri ..... F24H 3/0423
2006/0000110 A1 1/2006 Aisenberg et al.
2008/0181590 A1 * 7/2008 Radwill ..... F24H 3/0423 374/E3.001
2010/0008655 A1 * 1/2010 Tackitt ..... H05B 3/42 392/385
2013/0129328 A1 * 5/2013 Eberli ..... F24H 3/002 392/384
2018/0136275 A1 5/2018 Shimizu et al.

FOREIGN PATENT DOCUMENTS

DE 102019100850 A1 7/2020
DE 102020200799 A1 7/2021
EP 1956317 A2 8/2008
JP S61217648 A 9/1986
KR 101217249 B1 12/2012
WO 2020148063 A1 7/2020
WO 2021059288 A2 4/2021

OTHER PUBLICATIONS

International Search Report corresponding to application PCT/EP2022/074729, dated Dec. 6, 2022, 12 pages.
Written Opinion corresponding to application PCT/EP2022/074729, dated Dec. 6, 2022, 7 pages.
International Preliminary Examination Report corresponding to application PCT/EP2022/074729, dated Jul. 31, 2023, 12 pages.
English summary of Chinese Office Action corresponding to application 202280059894.4, dated Jun. 25, 2024, 14 pages.

* cited by examiner

HOT AIR HANDHELD DEVICE

CROSS-REFERENCE TO RELATED APPLICATIONS

This is a continuation application of co-pending international patent application PCT/EP2022/074729, filed Sep. 6, 2022 and designating the United States, which was published in German as WO 2023/031480 A1, and claims priority to German utility model application DE 20 2021 104 784.4, filed Sep. 6, 2021, both of which are incorporated herein by reference in their entireties.

TECHNICAL FIELD

The present invention relates to a hand-held hot air device or hot air hand blower with a housing for receiving at least a fan, a control device, actuating elements and a display and operating device as well as a heating tube arranged at the housing with an integrated heating element and temperature sensor.

BACKGROUND

Respective hand-held hot air devices are used in a wide variety of embodiments, for example for welding or shrinking plastics, drying objects, etc.

DE 10 2019 100 850 A1 relates to a hot-air fan and method for operating the same. The document discloses a hot-air fan including a fan device for generating an air flow, a heating device for heating the air flow, and a control unit connected to the fan device and to the heating device. In this process, the control unit is designed to control the fan device in such a manner that, when the heating device is switched on, the fan device generates a starting air flow that is reduced to an operating air flow. Further a method for operating the hot-air fan is provided, including the steps of switching on the heating device and generating a starting air flow that is reduced to an operating air flow.

DE 10 2020 200799 A1 relates to a distance heating device, in particular a hot air gun device, with a heat output unit for heating a surface, with a sensor unit for determining at least one piece of information relating to the surface and with a control unit at least for controlling the heat output unit. It is proposed that the information comprises at least one component different from a surface temperature of the surface and that the control unit triggers at least one function in at least one operating state based on the information.

EP 1 956 317 A2 relates to a heating device and method, wherein the heating device, such as a heat gun or a heating unit, comprises a surface temperature sensor for measuring the surface temperature of the workpiece to be heated.

JP S61 217648 A relates to a further hot air gun with a temperature sensor.

DE 20 2017 103466 U1 relates to a hand-held hot air device with a non-contact user communication interface.

In particular when used as a hot air welding device, it is important to know the temperature at the location at which welding is performed. This is usually at a certain distance in front of the outlet opening of the heating tube for the hot air. Additionally, the amount of hot air is to be taken into account thereby, which can often be varied with such hot air devices. To detect the temperature, a temperature sensor is arranged in the heating tube in the region between the heating element and the outlet opening, usually directly at the end of the heating element. In particular when using such temperature-controlled hand-held hot air devices in industry with very high requirements regarding process traceability and accuracy, for example in the transportation industry and in particular in the aviation industry, it is necessary that the temperature displayed on the hand-held hot air device corresponds to the temperature with which the work (welding/shrinking) is actually carried out. When the air emerges from the heating tube, the temperature is already lower than at the measuring location in the air flow just behind the heating element due to thermal losses. For this purpose, a calibration curve is stored in the control device used to regulate the hot air temperature in order to calculate the actual temperature at the air outlet from the temperature measured with the sensor. Hereby, a linear relationship is assumed and from two measurement points the slope and an offset are determined and stored. On the display of the hand-held hot air device only the determined temperature is shown then.

SUMMARY

However, if for example different nozzles are attached to the heating tube, the temperature at the location at which welding is to be performed changes depending on the nozzle. Also, if welding is carried out at a different location with a different distance from the outlet of the heating tube, for whatever reason, the temperature displayed does not correspond to the actual temperature at the work location.

An object of aspects of the present disclosure is to provide a further improved hand-held hot air device. It would be desirable to provide a possibility with which for any application the actual temperature can be displayed at a defined location in front of the heating tube.

The claimed subject matter is defined in the independent claims. Advantageous refinements are provided in the dependent claims.

Accordingly, according to one aspect of the present disclosure, in the control device there are provided calibration curves as a function of a plurality of different air guide options for the hot air emerging from the heating tube after the heating tube. The hand-held hot air device with the control device is configured to, after setting the respective air guide at the outlet from the heating tube, output the air temperature at the location corresponding to the air guide on the display in accordance with the calibration curve of the air guide. These calibration curves are for example determined linearly via respective measurements at a predetermined air volume with a lower temperature value and an upper temperature value and stored for the respective air guide option. Generally, this can be done with a total of four values (upper and lower temperature value at upper and lower air volume). Thereby a correct temperature display corresponding to the actual conditions can be displayed for different nozzles or at certain distances in front of the heating tube without nozzles after the user has selected the respective application.

Correspondingly, a method for operating a hand-held hot air device according to an aspect of the disclosure can comprise the following steps: providing the hand-held hot air device; setting the air guide at the outlet from the heating tube, wherein (a) in the control device as a function of a plurality of different air guide options for the hot air emerging from the heating tube after the heating tube there are provided calibration curves or, instead of the plurality of calibration curves being stored in the control device these are stored on a mobile communication device and the respective selected calibration curve can be loaded from the mobile communication device to the control device via a communication interface; and outputting the air temperature at the location corresponding with the air guide on the display in accordance with the calibration curve of the air guide.

Preferably, in the control device calibration curves depending on nozzles to be attached to the heating tube are provided.

According to a particularly preferred embodiment of an aspect of the disclosure, a communication interface for wireless communication for wireless transmission of data from and to a mobile communication device is provided in the hand-held hot air device. Generally, the display device can be used for displaying the plurality of air guide options and for their selection. Thereby, the various air guide options are illustrated on the display on the mobile communication device and can be selected by the operator. The calibration curves corresponding to the air guide options can already be stored in the control device of the hand-held hot air device and are selected via the communication device. Alternatively, the calibration curves are stored on the mobile communication device, are selected there and the selected calibration curve is transferred to the control device and stored there for this application. Preferably, according to a further embodiment, calibration curves stored on the mobile communication device are loaded from the mobile communication device to the control device.

According to a particularly preferred embodiment of the hand-held hot air device, it is possible to calculate a new calibration curve from measured temperature values at a relevant location for the respective air flow with a corresponding assigned air volume using a formula stored in the communication device. As described above, this can then be transmitted to the control device and stored there for this application. This embodiment is particularly advantageous if either a new nozzle for which no calibration curve is available shall be used or the temperature at a very specific location in front of the heating tube is important and should therefore be adjustable and displayed. Alternatively, it is also possible that the formula is stored in the control device and only the measured values are transmitted from the communication device to the control device.

Hereby, the temperature at the desired location can be determined by an external temperature probe, which is either connected to a respective display such that the data can be entered into the mobile communication device for calculating the calibration curve or is connected directly to the mobile communication device. With this feature, it is also possible for a user to define his calibration curve exactly for the temperature range in which he usually operates the hand-held hot air device.

The hand-held hot air device according to an aspect of the disclosure thus allows adaptation to different application scenarios in a simple manner, regardless of whether these applications were already taken into account upon delivery of the hand-held hot air device. Either the existing calibration curves can be used, or a new calibration curve can be created by additional measurements.

The features and combinations of features mentioned above in the description as well as the features and combinations of features mentioned in the following in the description of figures and/or shown solely in the figures can be used not only in the respective indicated combination, but also in other combinations or on their own. Individual features of the independent claims can also be replaced by other disclosed features or combinations of features.

DETAILED DESCRIPTION

Figure 1:
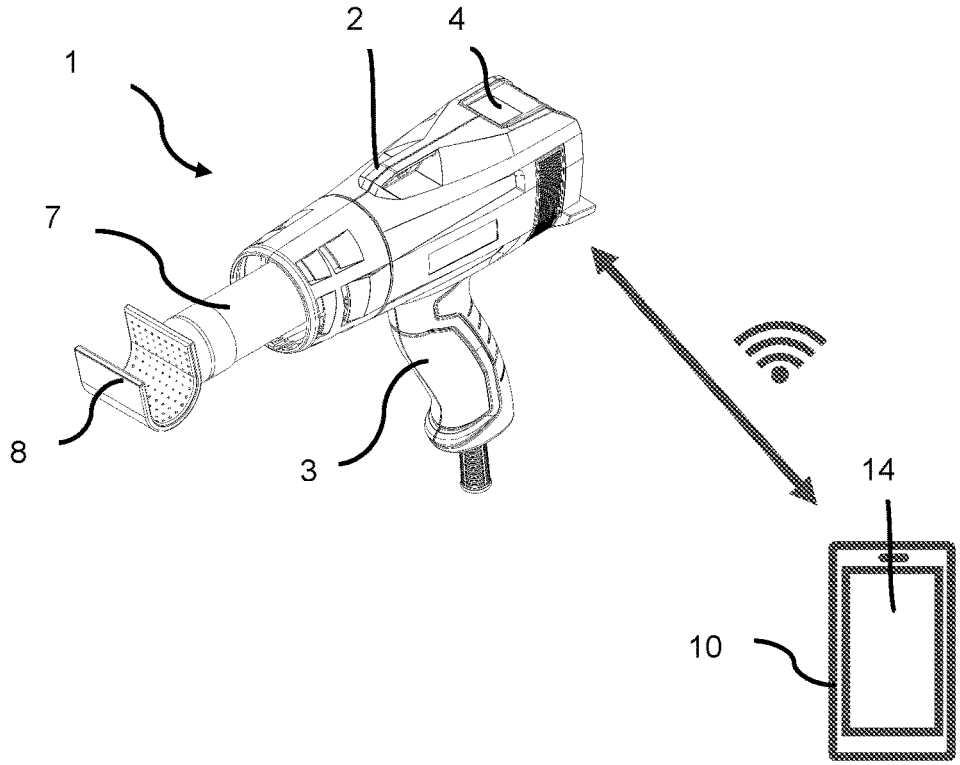
FIG. 1 shows a perspective view of a hand-held hot air device with a nozzle attached to the heating tube, which communicates with a mobile telecommunications device.
Figure 2:
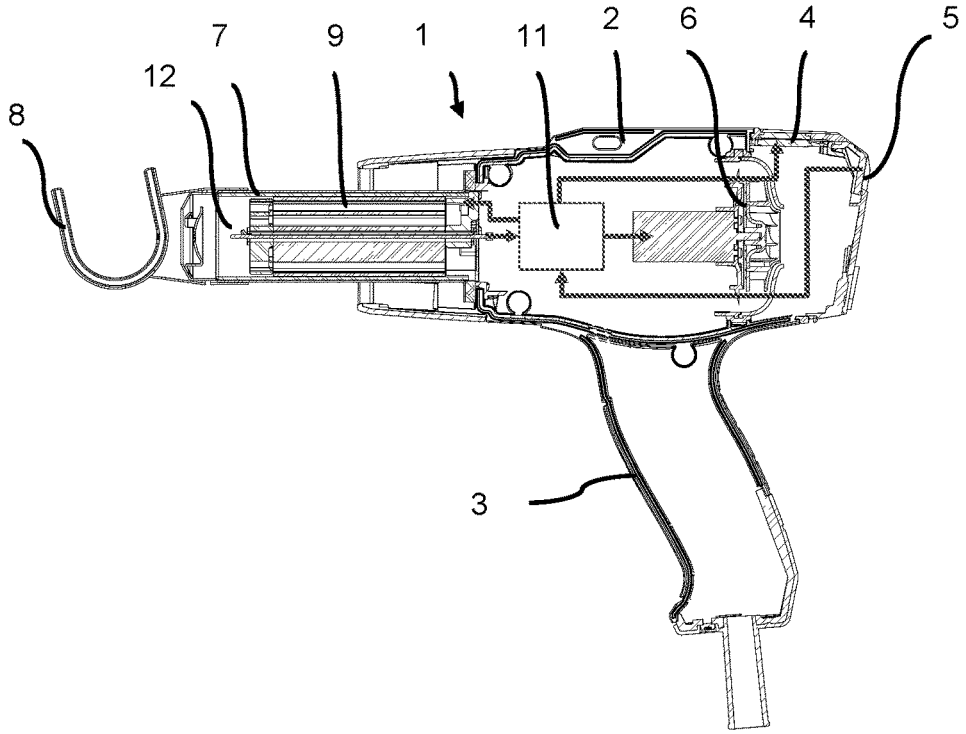
FIG. 2 shows a sectional view of the hand-held hot air device according to FIG. 1 with a schematic illustration of the electrical communication paths as a block diagram.

The hand-held hot air device 1 shown in FIG. 1 is an externally usual hand-held hot air device 1 with a housing 2, a handle 3 and a display and operating device 4 in the form of an input screen as well as an on switch 5 (FIG. 2) on the housing 2. Inside the housing 2 is a fan 6 (FIG. 2) via which air is discharged through the heating tube 7 through a nozzle 8 attached to the heating tube 7. Inside, as shown in FIG. 2, there is a heating element 9. The embodiment shows the operation of the hand-held hot air device 1 with of a mobile telecommunications device 10 with display screen 14. The hand-held hot air device can be operated without the same as well via the display 4, which is also configured as an input screen.

FIG. 2 schematically illustrates a control circuit with a control device 11 that receives signals from a sensor 12 at the hot air end of the heating element 9. In the control device 11 linear calibration curves are provided, which assign an actual temperature value shown on the display 4 to the respective measured value from the sensor 12. The calibration curve can also be influenced by the respective air volume, so that a different calibration curve results depending on the air volume. The control device 11 thus also controls and regulates the fan 6 and indicates the respective temperature on the display 4. The control device 11 also controls and regulates the heating element 9. In the application with the mobile telecommunications device 10, the control device 11 also comprises a telecommunications interface that communicates with the mobile telecommunications device 10. Accordingly instead of the display on the input screen 4, all possible stored calibration curves can, for example by the corresponding symbol of the nozzle or a distance from the outlet end of the heating tube 7, be illustrated on the telecommunications device 10 for selection by the operator. The operator then selects the calibration curve provided in the control unit 11 for the application and the selection signal is transmitted to the telecommunications interface. This embodiment of the hot air device with communication interface also allows that not all the respective calibration curves have to be stored in the control device 11 but to store them on the mobile telecommunications device 10 and only the respective application to be transmitted to the control device 11 and stored there.

Figure 3:
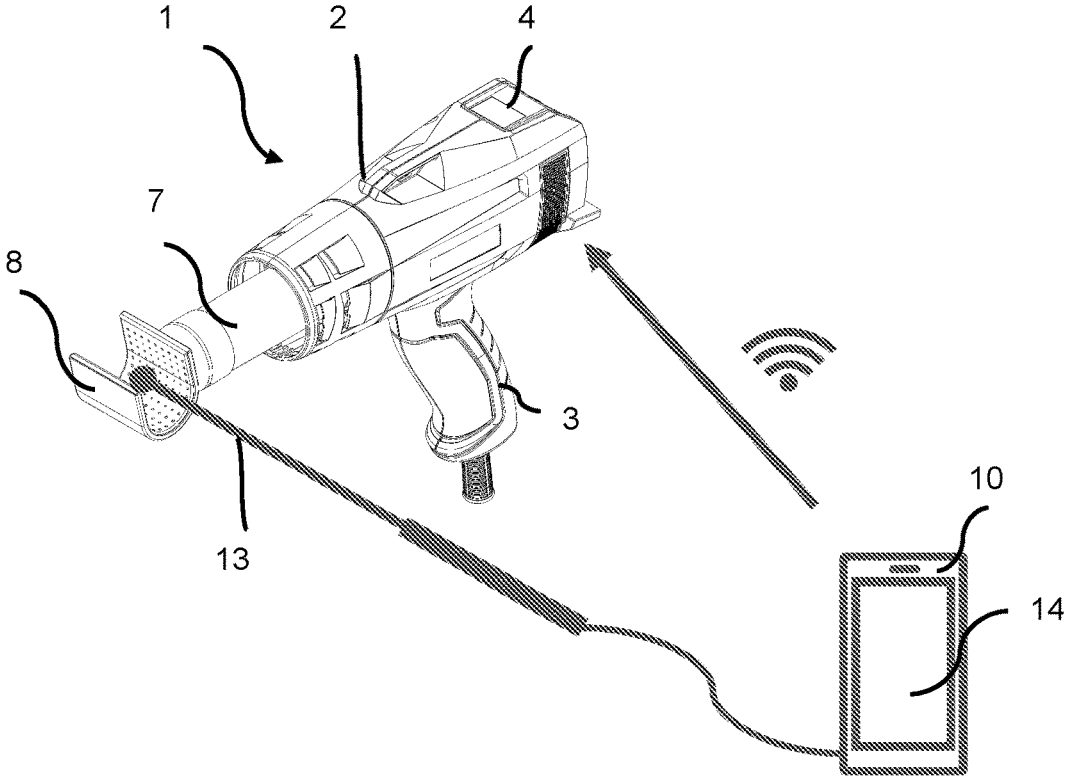
FIG. 3 shows the arrangement during the acquisition of a new calibration curve.

FIG. 3 illustrates a further temperature sensor 13 with which the temperature of a new nozzle 8 is determined and transmitted to the mobile telecommunications device 10. Through acquisition of temperature values at certain air volumes and using a calculation formula provided on the mobile telecommunications device 10, the calibration curve required for this application can be calculated and transmitted to the control device 11 and stored there. Thereby new applications can also be taken into account with an accurate temperature display. Generally, it is also possible that the measured temperature values from the sensor 13 are entered manually into the telecommunications device 10.

Figure 4:
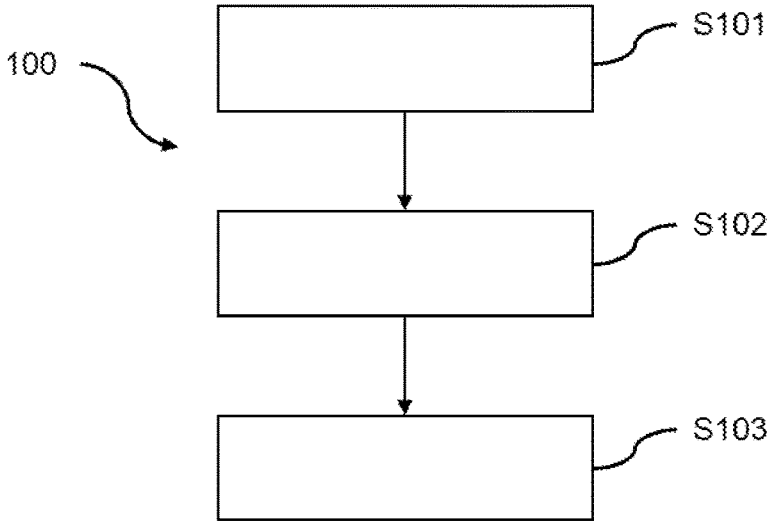
FIG. 4 shows a flowchart of a method for operating a hand-held hot air device.

FIG. 4 illustrates a flowchart of a method 100 for operating a hand-held hot air device. In a first step S101, a hand-held hot air device 1 is provided. Hereby, the hand-held hot air device can be a hand-held hot air device as described above. In step S102, the air guide after the outlet from the heating tube 7 is set (or predetermined or determined), wherein (a) in the control device 11 as a function of a plurality of different air guide options for the hot air emerging from the heating tube 7 after the heating tube 7 there are provided calibration curves or (b) instead of the plurality of calibration curves being stored in the control device 11 these are stored on a mobile communication device 10 and the respective selected calibration curve can be loaded from the mobile communication device 10 to the control device 11 via a communication interface. In other words, the calibration curves can alternatively be stored on the mobile communication device, are selected there and the selected calibration curve is transmitted to the control device and stored there for the application scenario. In step S103, the air temperature at the location corresponding to the air guide is output on the display 4 in accordance with the calibration curve of the air guide.

It is to be understood that the foregoing description is of one or more embodiments of the invention. The invention is not limited to the particular embodiment(s) disclosed herein, but rather is defined solely by the claims below. Furthermore, the statements contained in the foregoing description relate to the disclosed embodiment(s) and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all of the following: "A"; "B"; "C"; "A and B"; "A and C"; "B and C"; and "A, B, and C."

The invention claimed is:

1. A hand-held hot air device with a housing for at least a fan, a control device, actuating elements and a display and operating device as well as a heating tube arranged at the housing with an integrated heating element and temperature sensor, wherein in the control device as a function of a plurality of different air guide options for the hot air emerging from the heating tube after the heating tube there are provided calibration curves, wherein the hand-held hot air device with the control device is configured to, after setting the respective air guide at the outlet from the heating tube, output the air temperature at the location corresponding with the air guide on the display in accordance with the calibration curve of the air guide.

2. The hand-held hot air device according to claim 1, wherein in the control device calibration curves as a function of nozzles to be attached to the heating tube are provided, wherein the hand-held hot air device with the control device is configured to, after setting the nozzle used, output the air temperature at the outlet of the nozzle on the display in accordance with the calibration curve of the nozzle used.

3. A system comprising the hand-held hot air device according to claim 1 and a mobile communication device, wherein the hand-held hot air device comprises a communication interface for wireless communication for wireless transmission of data from and to the mobile communication device, wherein the calibration curves corresponding to the air guide options are provided on a display on the mobile communication device and are selectable.

4. The system according to claim 3, wherein calibration curves stored on the mobile communication device can be loaded from the mobile communication device to the control device.

5. A system comprising the hand-held hot air device according to claim 1 and a mobile communication device, wherein the hand-held hot air device comprises a communication interface for wireless communication for wireless transmission of data from and to the mobile communication device, wherein measured temperature values at a relevant location for the respective air guide at a corresponding assigned air volume can be loaded from a mobile communication device to the control device, which calculates and stores a new calibration curve based on a formula stored therein.

6. A system comprising the hand-held hot air device according to claim 1 and a mobile communication device, wherein instead of the plurality of calibration curves being stored in the control device of the hand-held hot air device these are stored on the mobile communication device and the respective selected calibration curve can be loaded from the mobile communication device to the control device via a communication interface.

7. The system according to claim 6, wherein the mobile communication device calculates and stores a new calibration curve from measured temperature values at a position relevant for the respective air guide at a corresponding assigned air volume based on a formula stored in the communication device.

8. A hand-held hot air device with a housing for at least a fan, a control device, actuating elements and a display and operating device as well as a heating tube arranged at the housing with an integrated heating element and temperature sensor, wherein the hand-held hot air device with the control device is configured to, after setting the respective air guide at the outlet from the heating tube, output the air temperature at the location on the display corresponding with the air guide in accordance with a calibration curve of the air guide, wherein in the control device as a function of a plurality of different air guide options for the hot air emerging from the heating tube after the heating tube there are provided calibrations curves.

9. A hand-held hot air device with a housing for at least a fan, a control device, actuating elements and a display and operating device as well as a heating tube arranged at the housing with an integrated heating element and temperature sensor, wherein the hand-held hot air device with the control device is configured to, after setting the respective air guide at the outlet from the heating tube, output the air temperature at the location on the display corresponding with the air guide in accordance with a calibration curve of the air guide, wherein the hand-held hot air device comprises a communication interface for wireless communication for wireless transmission of data from and to a mobile communication device, wherein as a function of a plurality of different air guide options for the hot air emerging from the heating tube after the heating tube calibration curves are stored on the mobile communication device and the hand-held hot air device is configured to load the respective selected calibration curve from the mobile communication device to the control device via the communication interface.

10. A method for operating the hand-held hot air device according to claim 1, comprising the steps of:

providing the hand-held hot air device;

setting the air guide at the outlet from the heating tube, wherein in the control device as a function of a plurality of different air guide options for the hot air emerging from the heating tube after the heating tube there are provided calibration curves; and outputting the air temperature at the location corresponding with the air guide on the display in accordance with the calibration curve of the air guide.

11. A method for operating a hand-held hot air device according to claim 1, comprising the steps of:

providing the hand-held hot air device;

setting the air guide at the outlet from the heating tube, wherein as a function of a plurality of different air guide options for the hot air emerging from the heating tube after the heating tube calibration curves are stored on a mobile communication device and the respective selected calibration curve can be loaded from the mobile communication device to the control device via a communication interface; and outputting the air temperature at the location corresponding with the air guide on the display in accordance with the calibration curve of the air guide.

12. A method for operating the hand-held hot air device according to claim 9, comprising the steps of:

providing the hand-held hot air device;

setting the air guide at the outlet from the heating tube, wherein in the control device as a function of a plurality of different air guide options for the hot air emerging from the heating tube after the heating tube there are provided calibration curves; and outputting the air temperature at the location corresponding with the air guide on the display in accordance with the calibration curve of the air guide.

13. A method for operating a hand-held hot air device according to claim 9, comprising the steps of:

providing the hand-held hot air device;

setting the air guide at the outlet from the heating tube, wherein as a function of a plurality of different air guide options for the hot air emerging from the heating tube after the heating tube calibration curves are stored on a mobile communication device and the respective selected calibration curve can be loaded from the mobile communication device to the control device via a communication interface; and outputting the air temperature at the location corresponding with the air guide on the display in accordance with the calibration curve of the air guide.

* * * * *